United States Patent [19]

Peterson

[11] Patent Number: 4,845,778

[45] Date of Patent: Jul. 11, 1989

[54] CHILD'S CRAWLER GARMENT

[76] Inventor: Leslie A. Peterson, 111 Edward St., Fairfield, Conn. 06430

[21] Appl. No.: 249,308

[22] Filed: Sep. 26, 1988

[51] Int. Cl.[4] ..... A41D 1/06

[52] U.S. Cl. ..... 2/24

[58] Field of Search ..... 2/23, 24, 62, 227, 243 A, 2/243 R, 243 B, 269, 244, 49 R

[56] References Cited

U.S. PATENT DOCUMENTS

| | | | |
|---|---|---|---|
| 2,862,834 | 12/1958 | Hiler | 427/274 |
| 2,905,944 | 9/1959 | Stuart et al. | 2/83 |
| 3,394,405 | 7/1968 | Conklin | 2/227 |
| 3,645,768 | 2/1972 | Coco et al. | 427/373 |
| 4,006,273 | 2/1977 | Wolinski et al. | 427/373 X |
| 4,044,176 | 8/1977 | Wolinski et al. | 427/373 X |
| 4,069,515 | 1/1978 | Swallow et al. | 2/239 |
| 4,149,274 | 4/1979 | Garrou et al. | 2/83 X |
| 4,287,884 | 9/1981 | Applegate | 2/24 X |
| 4,488,314 | 12/1984 | Johnson | 2/23 |
| 4,580,297 | 4/1986 | Maejima | 2/24 X |
| 4,651,354 | 3/1987 | Petrey | 2/239 |

*Primary Examiner*—Werner H. Schroeder
*Assistant Examiner*—Jeanette E. Chapman
*Attorney, Agent, or Firm*—Arthur T. Fattibene

[57] ABSTRACT

This disclosure is directed to a child's crawler garment and a method of making the garment which is a pair of pants having leg portions which are formed in the vicinity of the knee area with a design made of a thermal heat settable material which, when subjected to heat, is caused to raise slightly above the surface of the garment to form an anti-skid surface to prohibit a crawling infant from sliding or falling. Also, an embossed or roughened knee area may provide for an anti-slip surface.

2 Claims, 1 Drawing Sheet

FIG. 1
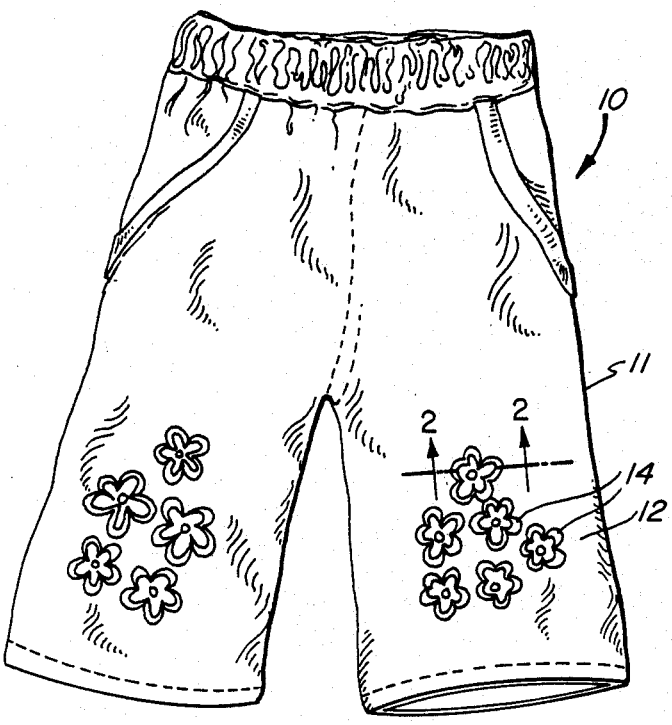
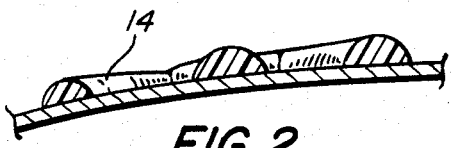
FIG. 2
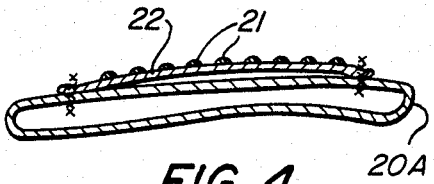
FIG. 4
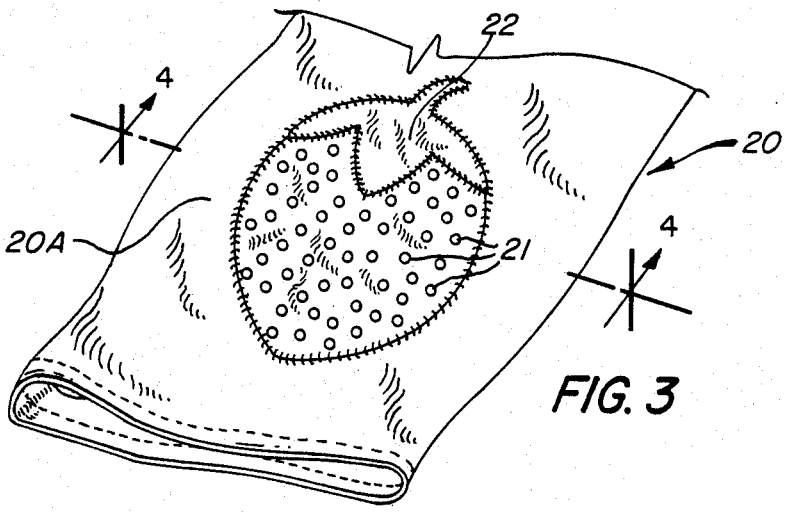
FIG. 3

CHILD'S CRAWLER GARMENT

FIELD OF INVENTION

This invention is directed to a child's garment for use during the crawling stage of an infant, and to the method of making such garment.

PRIOR ART

Heretofore, children's garments made for crawling infants consisted essentially of a pair of pants which were designed for ease of putting on or taking off. The leg portions of such crawler garments consisted of only the material from which the garment was made. It has been noted that an infant dressed in such prior known garments would invariably slip or fall in crawling along a floor. Such slipping is aggrevated when a child crawls along a wooden floor or a linoleum covered floor. Because of such slippage, an infant just learning to crawl would encounter considerable difficulty and could be subject to injury.

OBJECTS

An object of this invention is to provide an improved crawler's garment by forming the garment with an anti-skid surface applied to the knee area of the garment so that in use, the wearer will not slide or skid when crawling.

Another object is to provide an infant crawler garment with an anti-skid surface formed in the knee area thereof with a printed surface that will cure to form a raised anti-skid design.

Another object is to provide an infant's crawler garment with a friction producing knee pad.

Another object is to provide an infant's crawler garment having a heat settable design printed on the knee area of the garment which, when set, forms a raised pattern to form an anti-skid surface thereat.

Another object is to provide a method of making an infant's crawler garment with protected knee portions to prevent a crawling infant from slipping.

Another object is to provide a method for making an infant's garment with an anti-skid surface in the vicinity of the knee area by printing a predetermined design formed of a heat setting material to define an anti-skid surface.

SUMMARY OF THE INVENTION

The foregoing objects and other features of the invention are attained by an infant's crawler garment in the form of pants having extended leg portions, and which leg portions have formed or attached thereto in the vicinity of the knee area, an anti-skid or slip design. In accordance with this invention, the anti-skid or slip design is formed by printing or applying to the knee area of the garment a design formed of a heat settable material, which after heating, will expand to form a raised anti-slip area or portion at the knee area of the garment. In another form of the invention, the anti-skid design is formed in the shape of a decorative knee pad which has formed thereon the non-skid design defined by the heat settable material, and which knee pad is then attached or sewn to the infant's garment.

FEATURES

A feature of this invention resides in the forming of an infant's crawler garment with an anti-skid design in the vicinity of the knee area of the garment.

Another feature resides in the provision of printing on the knee area of an infant's crawer garment a design formed of a heat settable material, which after curing, forms a raised and safe anti-skid surface.

Another feature resides in the method of making an infant's garment to prohibit a crawling infant from slipping or sliding.

Other features and advantages will become more readily apparent when considered in view of the specification and drawings in which:

FIG. 1 is a front view of a crawler's garment embodying the invention.

FIG. 2 is a sectional detail view taking along line 2—2 on FIG. 1.

FIG. 3 is a modified embodiment of the invention.

FIG. 4 is a sectional view taking on line 4—4 of FIG. 3.

DETAIL DESCRIPTION

Referring to FIGS. 1 and 2, there is illustrated an embodiment of a child's garment 10 constructed in accordance with this invention. The illustrated garment 10 comprises a pair of pants 11 having leg portions 12 and 13. It will be understood that the garment or pants may be formed in any conventional manner. It will also be understood that the garment 10 may be formed as a coverall. The garment or pants of this invention are sized so as to be worn by infants when in their crawling stage.

To prohibit an infant from sliding or falling when crawling, there is formed or attached to the knee area of the garment 10, an anti-slip or skid surface. In accordance with this invention, this is attained by printing or forming on the knee area of the garment 10 a design, image or pleasing configuration formed of a material which can be readily printed or painted upon the external surface of the garment, and which material, upon setting or curing, will expand and form raised characters 14, as best shown in FIG. 2. The nature of the material is such that it has a rubbery feel, such that it will function as an anti-skid an anti-slip surface. Various materials which are readily commercially available may be used to form the design or raised surface as hereinbefore described. One such material that can be so used is sold under the tradename "Puffy Pen" manufactured by Tulip Productions, a division of Polymerics, Inc. of Waltham, Massachusetts. This material can be readily painted directed onto the surface of fabric to form the desired design, and then subjected to heat to cure or set the material. Upon curing, the material will swell to provide the raised design. Other graphic forming material that may be utilized to form the designed raised designs may be those disclosed in U.S. Pats. Nos. 2,862,834; 3,645,768; 4,006,273; 4,044,176 and 4,268,615.

It will be understood that the material from which the design is made may be formed by other methods such as by printing, screen printing, by a decal process and any other suitable process; which, when cured or set, will function to define an anti-skid or slip surface on the garment.

FIGS. 3 and 4 illustrate a modified embodiment. In this form of the invention, the garment 20 is similar in construction to garment 10 of FIG. 1. However, in this form of the invention, the design 21 is printed onto a patch of fabric 22 which is attached as a knee pad to the leg portion 20A of garment 20. In the illustrated embodiment, the knee patch 22 may be shaped in the form of a pleasing design or configuration with the material forming the raised design 21 being made an integral part of the design or configuration of the patch 22. In the illustrated embodiment, the shape of the patch 22 is in the form of a strawberry and the material forming the raised portion of the design supplies the textured appearance of a strawberry, and which textured appearance imparts the anti-skid or slip surface for the knee area of the garment. While a strawberry design is illustrated, it will be understood that the same result can be achieved with any other design configuration which may be pleasing to a child or infant.

In the embodiment disclosed, it will be apparent that the construction is such so as to render the garment both pleasing in design or fashion and functional in a utilitarian manner by forming a positive anti-skid surface to prevent a crawler or infant from slipping or falling on his or her face. Thus, the garment described provides a degree of safety and confidence not provided by conventional crawler garments.

An alternate construction for providing an anti-slip surface for a child's crawler garment may comprise a pad formed of a suitable fabric, plastic or other material which is capable of being embossed or formed with a roughened surface that will allow for some friction to occur that would prevent slipping or sliding as a child crawls. A suitable material comprises a vinyl pad formed in some child pleasing decorated form which has formed on a surface thereof, a wrinkling or other embossed or raised design which will impart some friction against a surface or floor. The pad so formed may be sewn or adhesively secured to the child's garment. In appearance, the construction may be similar to that shown in FIG. 3, with the exception that a raised design is integrally formed or embossed as an integral part of the vinyl pad or the like.

While the invention has been described with respect to several embodiments, variations and modifications may be made without departing from the spirit or scope of the invention.

What is claimed is:

1. A child's crawler garment comprising a pair of pants including leg portions having a knee area, a patch formed in a predetermined decorative shape, means connected to said patch to form an anti-skid surface thereon, said last mentioned means including a rubberized printing medium applied to said patch which is rendered expandible upon heating to define a raised relief non-slip design thereon, and means for securing said patch to the knee area of said pants.

2. A child's crawler garment comprising a pair of pants including leg portions having a knee area, a patch area having a predetermined decorative shape, means on said patch area forming an anti-slip surface on one side thereof, said last mentioned means including a heat settable printing medium applied to said patch area to provide a rubbery raised anti-slip surface on said patch area upon the application of heat thereto.

* * * * *